US008171897B2

(12) United States Patent
Sugiura

(10) Patent No.: US 8,171,897 B2
(45) Date of Patent: May 8, 2012

(54) COOLING STRUCTURE OF INTERNAL COMBUSTION ENGINE

(75) Inventor: Hiroyuki Sugiura, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 606 days.

(21) Appl. No.: 12/393,499

(22) Filed: Feb. 26, 2009

(65) Prior Publication Data

US 2009/0241866 A1 Oct. 1, 2009

(30) Foreign Application Priority Data

Mar. 27, 2008 (JP) ..... 2008-084708

(51) Int. Cl.
*F01P 1/00* (2006.01)

(52) U.S. Cl. ..... 123/41.56; 123/41.57; 123/41.35; 123/41.01; 123/41.55; 123/41.42

(58) Field of Classification Search ..... 123/41.56, 123/41.35, 41.01, 41.55, 41.42, 41.57
See application file for complete search history.

(56) References Cited

U.S. PATENT DOCUMENTS 4,147,140 A * 4/1979 Mansfield ..... 123/41.77
4,412,515 A * 11/1983 Fritzenwenger ..... 123/198 E
5,718,196 A * 2/1998 Uchiyama et al. ..... 123/195 C
6,244,225 B1 * 6/2001 Takahashi et al. ..... 123/41.82 R
7,165,516 B2 * 1/2007 Gokan et al. ..... 123/41.69
7,174,867 B2 * 2/2007 Gokan et al. ..... 123/90.31
2002/0005191 A1 * 1/2002 Maeda et al. ..... 123/572
2004/0206314 A1 * 10/2004 Gunji et al. ..... 123/41.82 R
2005/0109292 A1 * 5/2005 Gokan et al. ..... 123/41.69
2005/0115560 A1 * 6/2005 Kling ..... 128/200.24
2007/0227509 A1 * 10/2007 Ueda et al. ..... 123/509

FOREIGN PATENT DOCUMENTS

JP 59-5711 U 1/1984

* cited by examiner

*Primary Examiner* — Noah Kamen
*Assistant Examiner* — Long T Tran
(74) *Attorney, Agent, or Firm* — Westerman, Hattori, Daniels & Adrian, LLP

(57) ABSTRACT

A cooling structure of an internal combustion engine includes a cylinder block having a plurality of cylinder bores; a cylinder head disposed on an upper portion of the cylinder block; two camshafts disposed on the cylinder head so as to be juxtaposed to each other in parallel to a crankshaft; camshaft housing chambers formed on the cylinder head to house the respective camshafts; a recessed portion provided between the camshaft housing chambers; a plug seat formed between the camshafts and in the recessed portion; a cooling air passage formed between the cylinder bores; and cooling air introduction passages communicating from the cooling air passage to the recessed portion of the cylinder head.

8 Claims, 10 Drawing Sheets

COOLING STRUCTURE OF INTERNAL COMBUSTION ENGINE

TECHNICAL FIELD

The present invention relates generally to a cooling structure of an internal combustion engine, and particularly, to a cooling structure of an internal combustion engine for a motorcycle.

BACKGROUND OF THE INVENTION

A traditional cooling structure of an internal combustion engine is known, in which a passage bored along a cylinder of a cylinder block having a plurality of cylinders allows an opening formed in a windward side surface of the cylinder block to communicate with an opening formed in an upper surface of the cylinder head, so that cooling air is guided between the cylinders and to the upper surface of the cylinder head (see e.g. Japanese Utility Model Laid-Open No. Sho 59-005711.

Incidentally, the cooling structure of the internal combustion engine described in Japanese Utility Model Laid-Open No. Sho 59-005711 mentioned above aims to cool a position where the cylinders are adjacent to each other and is a technique of leading cooling air to the upper surface of the cylinder head for efficient introduction of the cooling air. Because of this, cooling of the cylinder head per se has been unconsidered.

The present invention has been made to eliminate such a disadvantage and aims to provide a cooling structure of an internal combustion engine that can improve cooling performance of the engine.

SUMMARY OF THE INVENTION

To achieve the above object, the invention is characterized in that a cooling structure of an internal combustion engine includes a cylinder block having a plurality of cylinder bores; a cylinder head disposed on an upper portion of the cylinder block; two camshafts disposed on the cylinder head so as to be juxtaposed with each other in parallel to a crankshaft; camshaft housing chambers formed on the cylinder head to house the respective camshafts; a recessed portion provided between the camshaft housing chambers; a plug seat formed between the camshafts and in the recessed portion; a cooling air passage formed between the cylinder bores; and a cooling air introduction passage communicating from the cooling air passage to the recessed portion of the cylinder head.

The invention is further characterized in that, in addition to the configuration of the invention above, a cam chain chamber for housing a cam chain is formed at a cylinder-arrangement central portion, the cooling air introduction passage is disposed adjacently to the cam chain chamber, and a cylinder-arrangement end of the recessed portion is formed to open toward the outside.

The invention is further characterized in that, in addition to the configuration of the invention recited above, the cooling air introduction passage is formed between the cylinder bores and forward of and rearward of a line connecting cylinder centers.

The invention is further characterized in that, in addition to the configuration of the invention recited above, the cam shaft housing chamber is formed to overhang toward the recessed portion, and at least a portion of the cooling air introduction passage is formed at a position hidden by the overhanging portion of the camshaft housing chamber, as viewed from the upper surface of the cylinder head.

According to the cooling structure of the internal combustion engine, the cooling air introduction passage communicating from the cooling air passage to the recessed portion of the cylinder head is provided; therefore, cooling air can efficiently be introduced into the recessed portion to improve the cooling performance of the recessed portion. This can positively cool the plug seat disposed in the recessed portion and particularly subjected to high-temperature to improve the cooling performance of the internal combustion engine. Even while the vehicle is being parked and no cooling air flows into the cooling air passage, the cooling air introduction passage allows the cylinder block to communicate with the recessed portion of the cylinder head; therefore, convection flow occurs due to the increased temperature of neighboring air. This movement of air introduces fresh air into the recessed portion while heated air does not stay therein. Thus, cooling performance of the internal combustion engine can be improved during idling.

According to the cooling structure of the internal combustion engine, the cam chain chamber for housing a cam chain is formed at the cylinder-arrangement central portion, the cooling air introduction passage is disposed adjacently to the cam chain chamber, and the cylinder-arrangement end of the recessed portion is formed to open toward the outside. Therefore, cooling air can be led to the side of the cam chain chamber where air tends to stay in the recessed portion, thereby further improving cooling performance of the internal combustion engine. Since the cylinder-arrangement directional outer end of the recessed portion is formed to open outwardly, the negative pressure of running air acts on the opening portion of the recessed portion. This further promotes the introduction of cooling air from the cooling air introduction passage to further improve the cooling performance of the recessed portion.

According to the cooling structure of the internal combustion engine, the cooling air introduction passage can be formed between the cylinder bores and forward of and rearward of a line connecting cylinder centers. Therefore, between the cylinder bores can be cooled to improve the cooling performance of the internal combustion engine.

According to the cooling structure of the internal combustion engine, the cam shaft housing chamber is formed to overhang toward the recessed portion, and at least a portion of the cooling air introduction passage is formed at a position hidden by the overhanging portion of the camshaft housing chamber as viewed from the upper surface of the cylinder head. Therefore, the space of the recessed portion can be increased by the camshaft housing chamber formed to overhang toward the recessed portion, thereby increasing the surface area to enhance cooling performance. It is possible to introduce cooling air into the overhanging portion where air tends to stay in the recessed portion, which can further improve the cooling performance of the internal combustion engine.

BRIEF DESCRIPTION OF THE DRAWINGS

The advantages of the invention will become apparent in the following description taken in conjunction with the drawings, wherein.

DETAILED DESCRIPTION OF THE INVENTION

Figure 1:
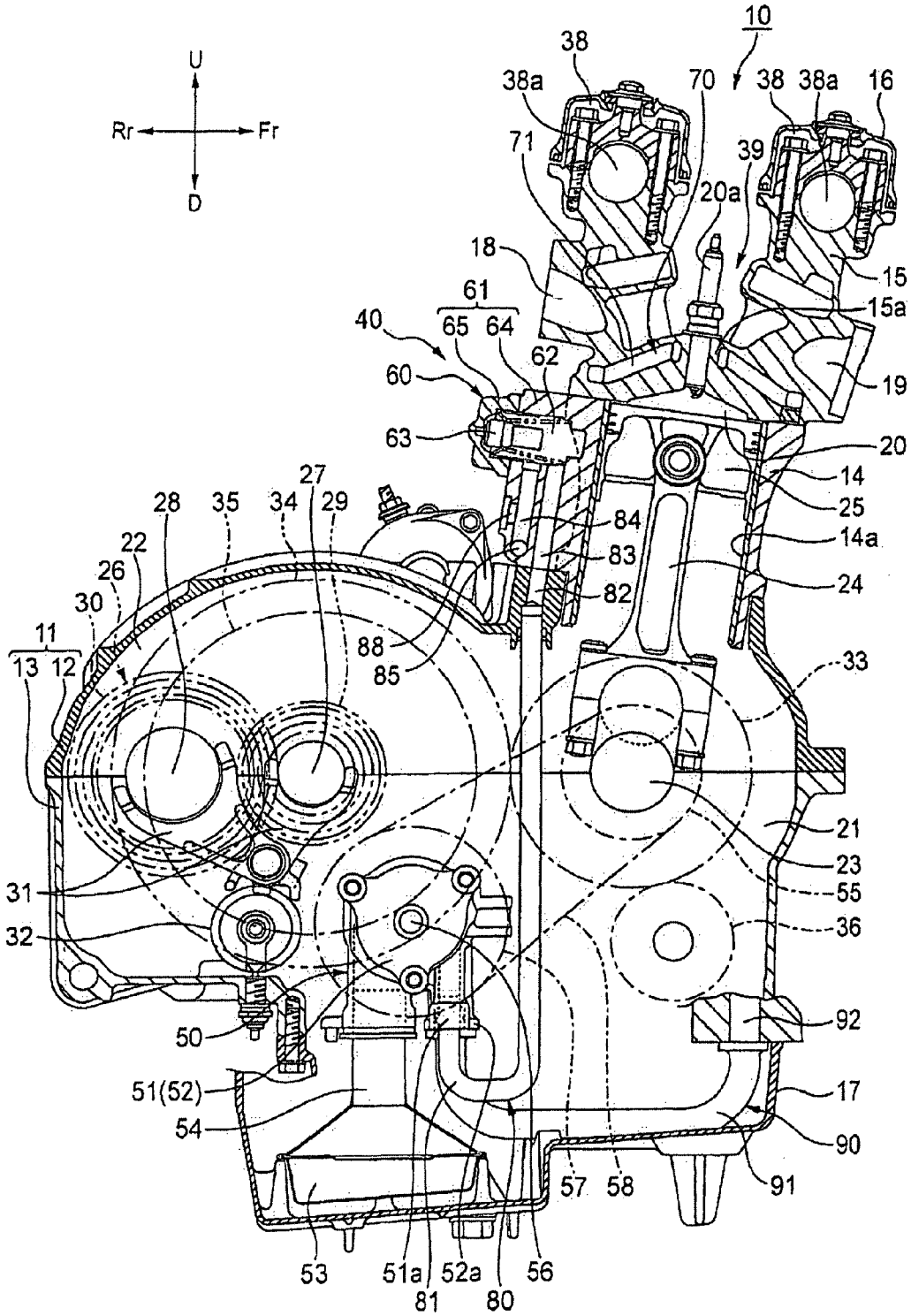
FIG. 1 is a partial cutout right lateral view explaining an embodiment of a cooling structure of an internal combustion engine according to the present invention.

An embodiment of a cooling structure of an internal combustion engine according to the present invention will hereinafter be described in detail with reference to the accompanying drawings. Incidentally, the internal combustion engine of the present embodiment may be mounted on a motorcycle (not shown). In the following description, the front and back or rear, the left and right, and upside and downside are based on the direction a rider faces. In the drawings, the front, back or rear, left, right, upside and downside of a motorcycle are denoted with Fr, Rr, L, R, U and D, respectively.

The internal combustion engine 10 of the present embodiment is an in-line four-cylinder engine as shown in FIG. 1. An outer shell of the engine mainly includes a crankcase 11 composed of an upper crankcase 12 and a lower crankcase 13; a cylinder block 14 mounted to the front upper end of the crankcase 11; a cylinder head 15 mounted to the upper end of the cylinder block 14; a cylinder head cover 16 covering the upper opening of the cylinder head 15; an oil pan 17 covering the lower end opening of the crankcase 11 and storing oil; and a crankcase side cover (not shown) covering the openings of the left and right lateral surfaces of the crankcase 11.

The cylinder head 15 is formed at a rear surface with an intake port 18 joined with a throttle body (not shown) and at a front surface with an exhaust port 19 joined with an exhaust pipe not shown. A combustion chamber 20 is formed below the lower surface of the cylinder head 15. A spark plug 20*a* is attached to a plug seat 15*a* of the cylinder head 15 so as to face the combustion chamber 20.

As shown in FIG. 1, the crankcase 11 includes a crank chamber 21 at a front portion and a transmission chamber 22 at a rear portion. A crankshaft 23 is rotatably journaled inside the crank chamber 21 via bearings (not shown) at a mating surface between the upper crankcase 12 and the lower crankcase 13. A piston 25 is connected to the crankshaft 23 via a connecting rod 24. The piston 25 is reciprocated in a cylinder axial direction in each of cylinder bores 14*a* of the in-line four cylinders included in the cylinder block 14. In the embodiment, the cylinder axis is arranged to be inclined forwardly of a vehicle traveling direction.

The transmission chamber 22 is disposed on the rear side of the cylinder block 14. A constant-mesh type transmission 26 is housed in the transmission chamber 22. This transmission 26 includes a main shaft 27, a countershaft 28, a plurality of drive gears 29, a plurality of driven gears 30, a plurality of shift forks 31 and a shift drum 32. The main shaft 27 and countershaft 28 are rotatably journaled via bearings not shown provided at a mating surface between the upper crankcase 12 and the lower crankcase 13. The drive gears 29 are provided on the main shaft 27. The driven gears 30 are provided on the countershaft 28 so as to mesh with the drive gears 29. The shift forks 31 are engaged with the drive gears 29 and with the driven gears 30. The shift drum 32 is turnably carried by the crankcase 11 so as to slidably move the shift forks 31 in an axial direction.

The rotational drive force of the crankshaft 23 is transmitted to the transmission 26 via a primary drive gear 33 provided on the crankshaft 23, a primary driven gear 34 provided on the main shaft 27 so as to mesh with the primary drive gear 33, and a clutch device 35 provided on the main shaft 27. A balancer gear 36 meshed with the primary drive gear 33 is housed in the crank chamber 21.

Figure 3:
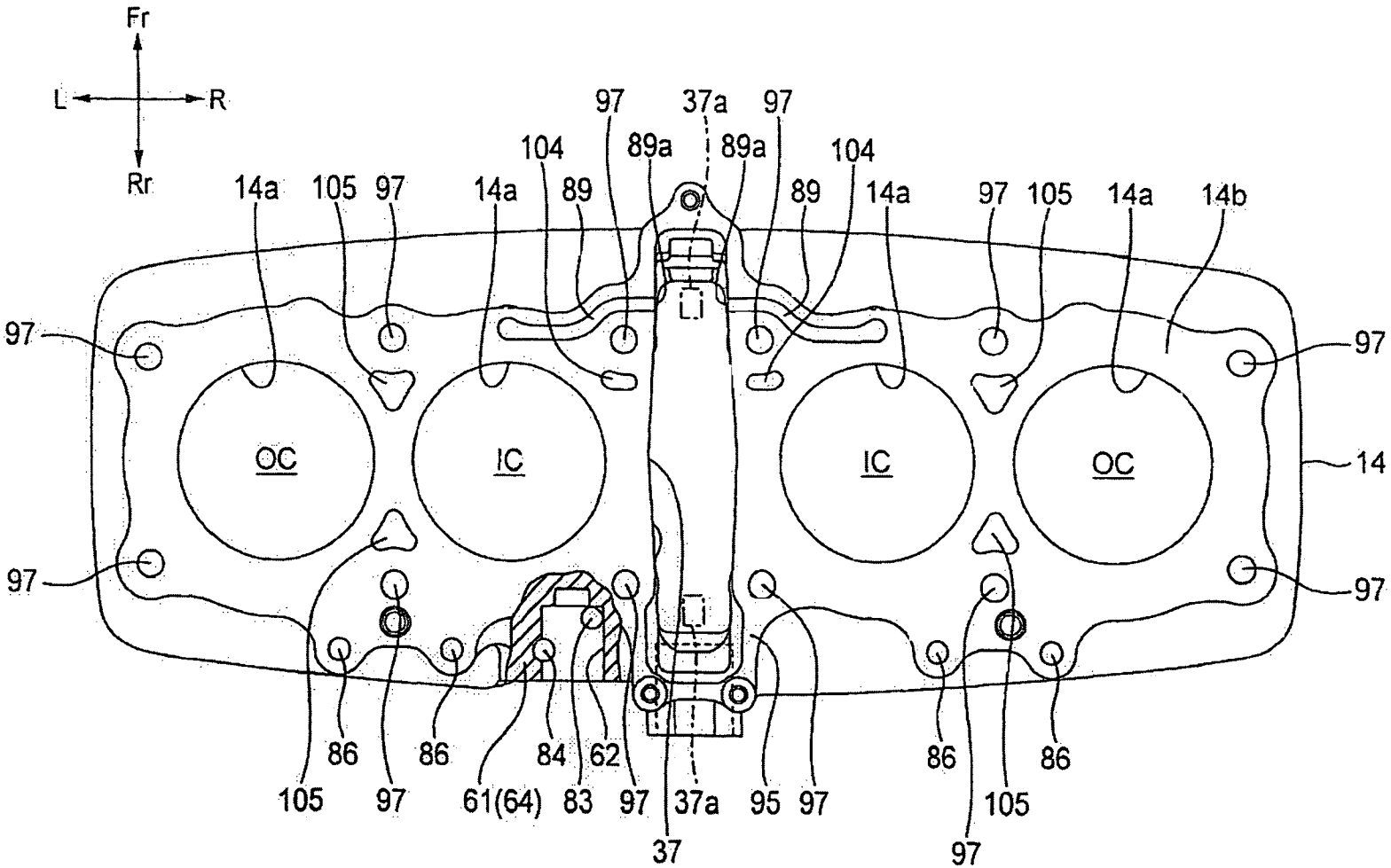
FIG. 3 is a plan view of the cylinder block shown in FIG. 2.
Figure 4:
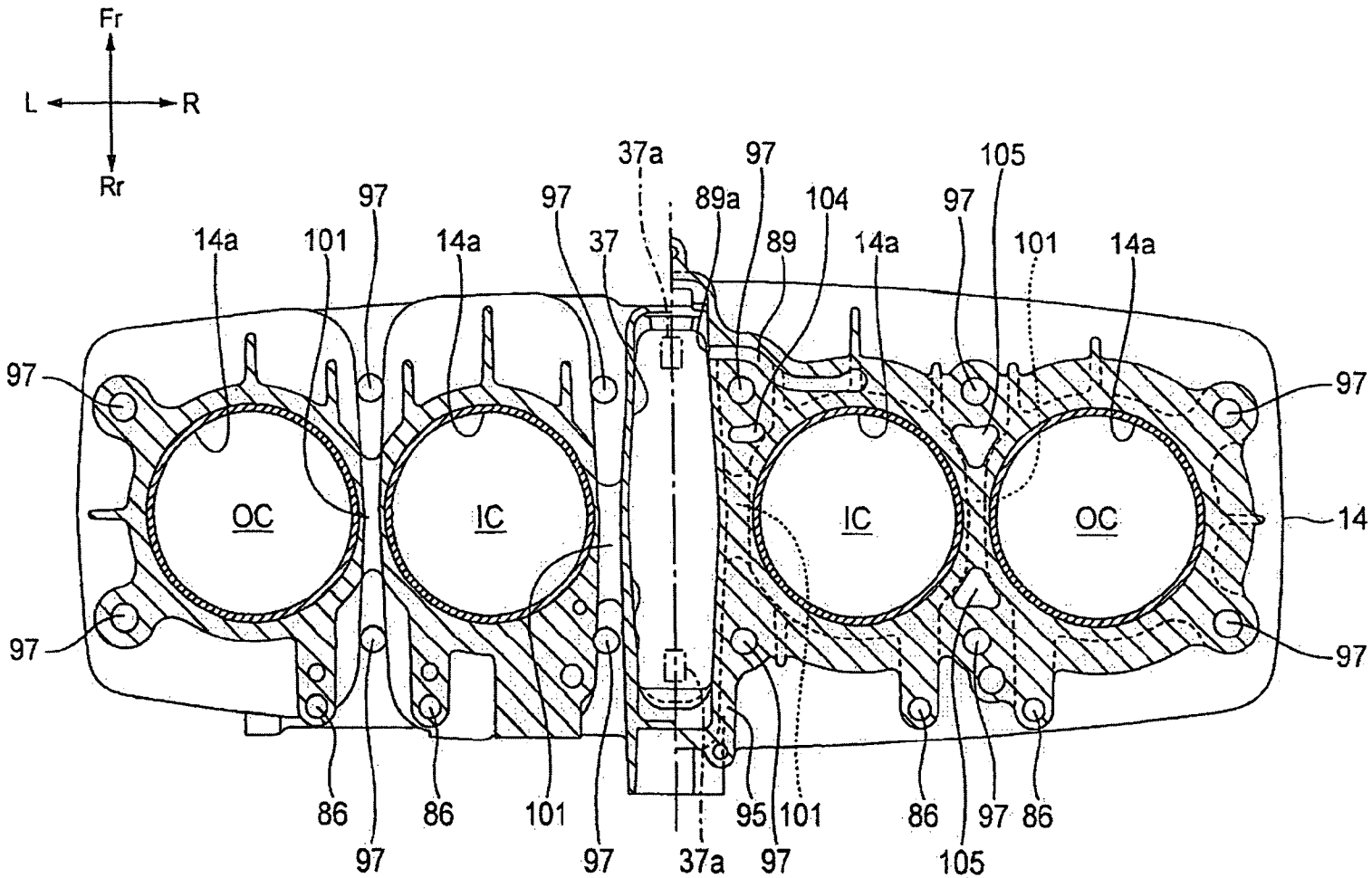
FIG. 4 is a cross-sectional view taken along line A-A of FIG. 2.
Figure 5:
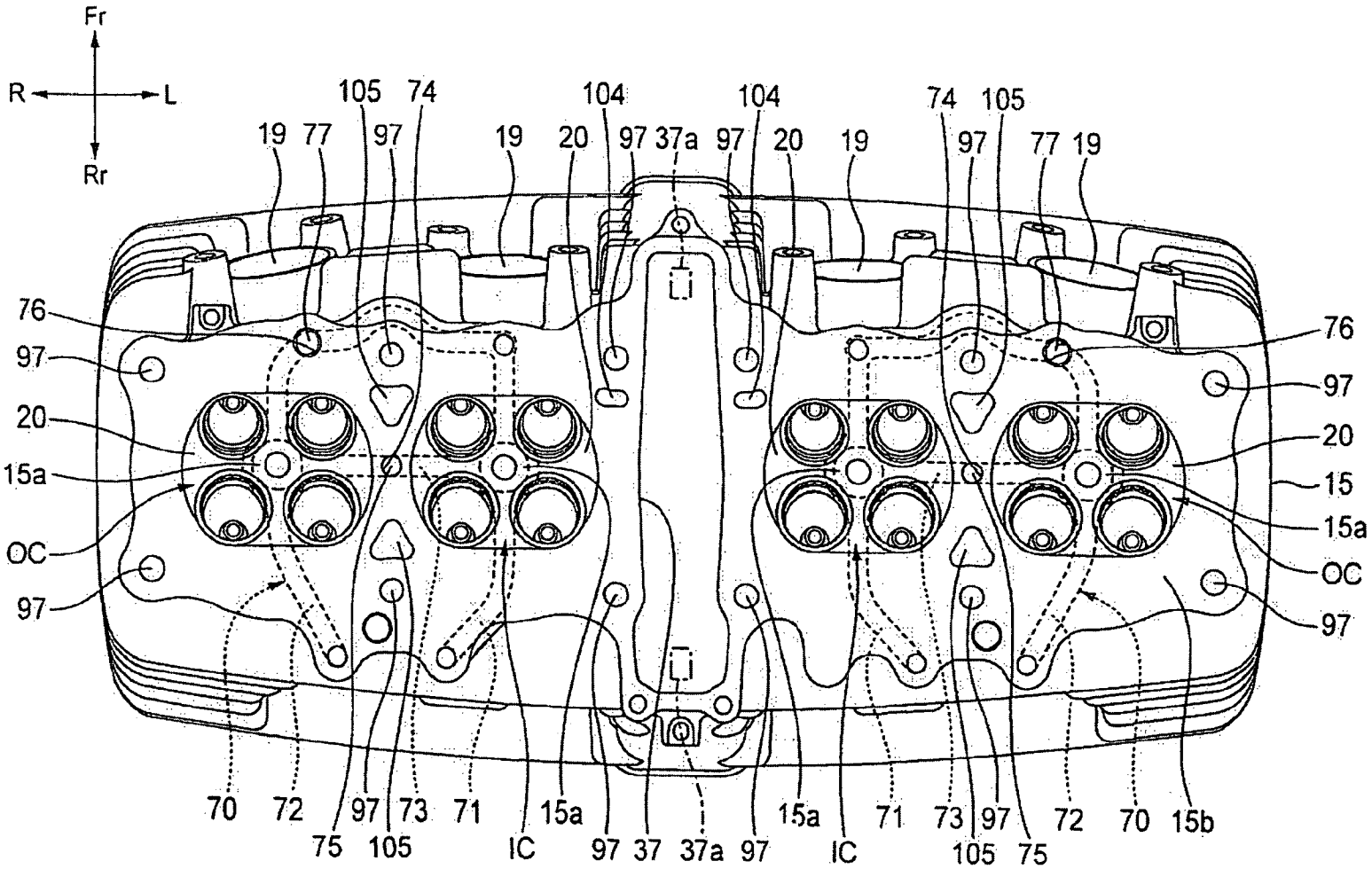
FIG. 5 is a bottom view of a cylinder head shown in FIG. 1.

As shown in FIGS. 3 through 5, the cylinder head 14 and the cylinder head 15 are formed with a cam chain chamber 37 at a central portion in a cylinder-arrangement direction. The cam chain chamber 37 houses a cam chain 37*a* adapted to drive a valve train (not shown) provided in the cylinder head 15. The cam chain chamber 37 communicates with the crank chamber 21.

Figure 8:
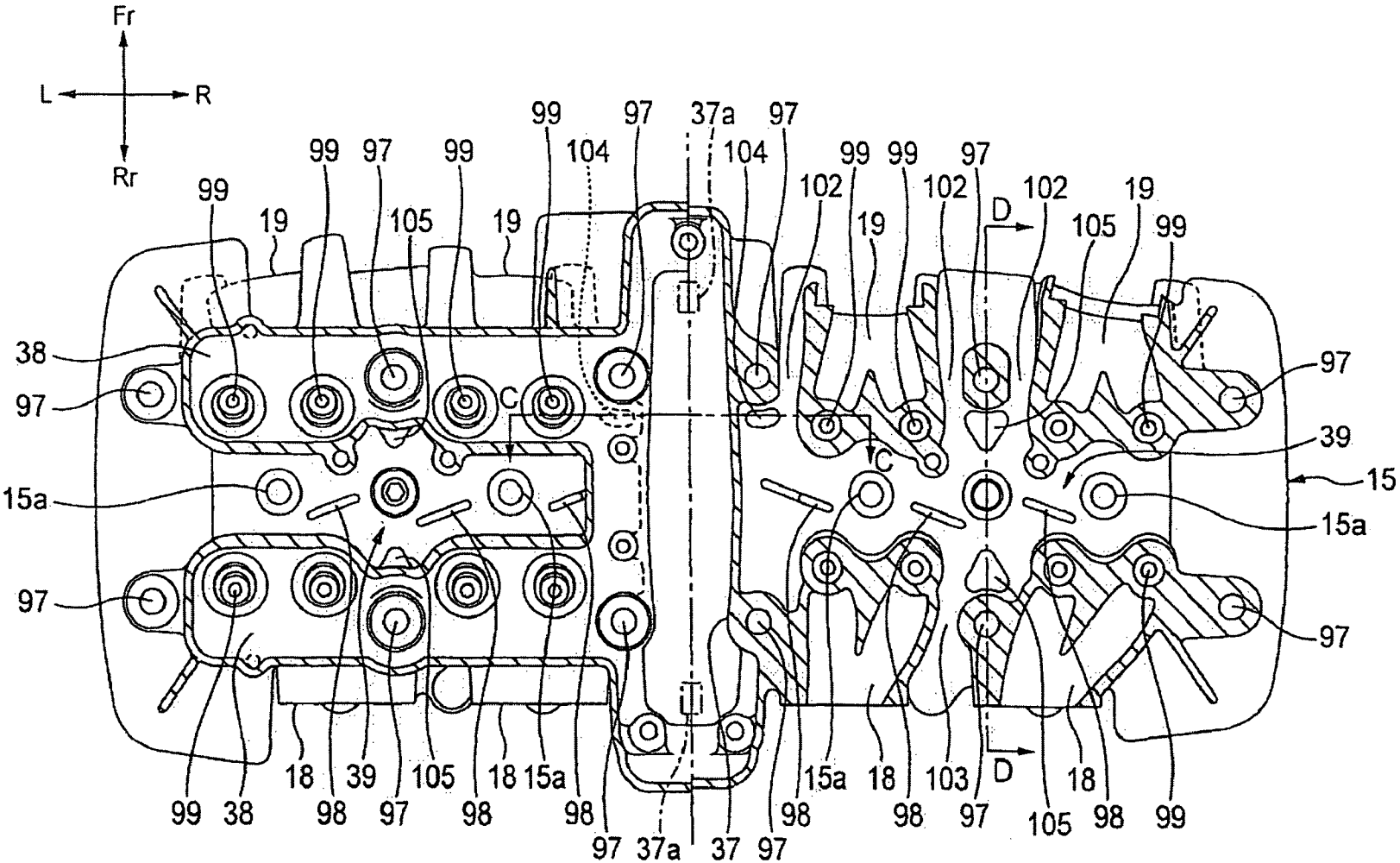
FIG. 8 is a cross-sectional view taken along line B-B of FIG. 7.
Figure 10:
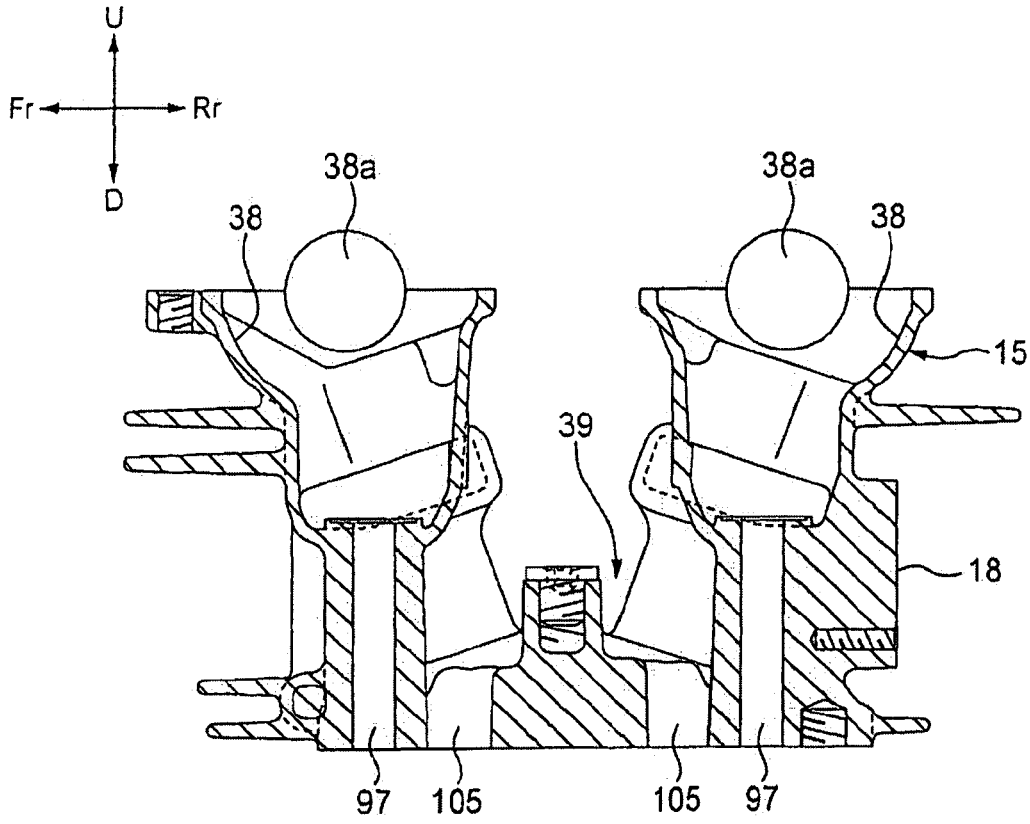
FIG. 10 is a cross-sectional view taken along line D-D of FIG. 8.

As shown in FIGS. 1, 8 and 10, two camshafts 38*a*, 38*a* of the valve train (not shown) are rotatably carried by the cylinder head 15 in parallel to the crankshaft 23. Camshaft housing chambers 38, 38 for housing the two respective camshafts 38*a*, 38*a* are formed independently of each other in the front to rear direction. Recessed portions 39 extending in the cylinder-arrangement direction are formed between the camshaft housing chambers 38, 38 on both sides of the cam chain chamber 37, i.e., formed to put the cam chain chamber 37 therebetween. The plug seats 15*a* are formed in the bottom portion of the recessed portion 39 at two respective positions in the cylinder-arrangement direction. The recessed portion 39 is opened at an external end portion in the cylinder-arrangement direction.

The internal combustion engine 10 of the embodiment is provided with a cooling system 40 for cooling the engine 10. As shown in FIGS. 1 through 5, the cooling system 40 mainly includes an oil pump unit 50, a thermostat 60, an oil jacket 70, an oil cooler (not shown), and a cooling system oil passage 80. The oil pump unit 50 sucks oil in the oil pan 17 and supplies it under pressure therefrom. The thermostat 60 is disposed on the rear surface portion of the cylinder block 14. The oil jacket 70 is formed inside the cylinder head 15 to allow circulating oil to cool heat transmitted from the combustion chamber 20. The oil cooler is adapted to cool oil. The cooling system oil passage 80 interconnects the oil pump unit 50, the thermostat 60, the oil jacket 70, the oil cooler and the crank chamber 21 for communication with one another.

As shown in FIG. 1, the oil pump unit 50 is mounted to the right lateral surface of the lower crankcase 13. In addition, the oil pump unit 50 includes a cooling oil pump 51 and a lubricating oil pump 52 horizontally juxtaposed to each other; a strainer 53 disposed close to the bottom of the oil pan 17; and an oil suction pipe 54 connecting each of the cooling oil pump 51 and the lubricating oil pump 52 with the strainer 53.

The oil pump unit 50 is driven by the rotational driving force of the crankshaft 23 transmitted via a pump drive gear 55, a pump driven gear 57, and a pump chain 58. The pump drive gear 55 is provided on the crankshaft 23. The pump driven gear 57 is provided on a pump shaft 56 shared by the cooling oil pump 51 and the lubricating oil pump 52. The pump chain 58 spans between, and is wound around, the pump drive gear 55 and the pump driven gear 57.

The thermostat 60 includes a thermostat case 61 disposed on the rear surface portion of the cylinder block 14 and a thermostat valve 63 housed in a thermostat chamber 62 formed in the thermostat case 61. The thermostat case 61 has a case main body 64 formed integrally with the cylinder block 14 and a lid portion 65 closing an upper end opening of the case body 64. The thermostat 60 switches between opening and closing of an oil discharge side connecting portion 87 which is an oil passage routed through an oil cooler (described later) and of a bypass passage 84 bypassing the oil cooler, in response to the temperature of oil flowing into the thermostat chamber 62. In the present embodiment, the thermostat 60 is disposed rearward of the cylinder block 14 and above the transmission chamber 22.

Referring to FIG. 5, the oil jacket 70 includes first jacket passages 71, 71, second jacket passages 72, 72, and jacket bypass passages 73, 73. The first jacket passages 71, 71 are respectively formed to be routed through the peripheries of plug seats 15*a* of two inside cylinders IC, IC from the sides of the intake ports 18 of the cylinder head 15 toward the exhaust ports 19. The second jacket passages 72, 72 are respectively formed to be routed through the peripheries of plug seats 15*a* of two outside cylinders OC, OC from the sides of the intake ports 18 of the cylinder head 15 toward the exhaust ports 19. Then, the second jacket passages 72, 72 merge at downstream ends with the corresponding downstream ends of the first jacket passages 71. The jacket bypass passages 73, 73 each allow the first jacket passage 71 and the second jacket passage 72 to communicate with each other on the periphery of the plug seat 15*a*.

A sand-stripping hole 74 is formed in the lower surface of an almost-central portion of the jacket bypass passage 73 included in the cylinder head 15 so as to draw collapsing sand of a core used to form the oil jacket 70. A sand-drawing plug 75 is fitted into the sand-stripping hole 74 so as to project into the jacket bypass passage 73.

As shown in FIGS. 1 through 5, the cooling system oil passage 80 includes a cooling oil supply pipe 81, a first oil supply passage 82, a second oil supply passage 83, a bypass passage 84, an oil distribution passage 85, oil branch passages 86, 86, 86, 86, an oil discharge side connecting portion 87, an oil return side connecting portion 88, and an oil discharge passage (an oil return passage) 89. The cooling oil supply pipe 81 is connected to a discharge port 51*a* of the cooling oil pump 51. The first oil supply passage 82 is formed at the front upper end of the upper crankcase 12 so as to extend upward and connects with the cooling oil supply pipe 81. The second oil supply passage 83 is formed in the rear surface portion of the cylinder block 14 so as to extend upward and communicate at its lower end with the first block oil supply passage 82 and at its upper end with the thermostat chamber 62. The bypass passage 84 is formed in the rear surface portion of the cylinder block 14 to extend downward and communicate with the thermostat chamber 62 at its upper end. The oil distribution passage 85 is formed in the rear surface portion of the cylinder block 14 to extend along the cylinder-arrangement direction and communicate with the lower end of the bypass passage 84. The oil branch passages 86, 86, 86, 86 are formed in the rear surface portion of the cylinder block 14 so as to extend upward and communicate with the oil distribution passage 85 at its lower end and with the corresponding respective upstream ends of the first and second jacket passages 71, 71, 72, 72 at its upper end. The oil discharge side connecting portion 87 is formed in the lid portion 65 of the thermostat case 61 to communicate with the thermostat chamber 62 and connect with a pipe led to the oil cooler. The oil return side connecting portion 88 is formed in the rear surface portion of the cylinder block 14 so as to connect with a return pipe led from the oil cooler and to communicate with the bypass passage 84. The oil discharge passage (the oil return passage) 89 is formed in the cylinder block 14, adapted to draw out oil from the oil jacket 70 and formed with a discharge port 89*a* opening in the cam chain chamber 37.

In the embodiment, as shown in FIG. 3, the oil discharge passage 89 communicates with the downstream end of the first jacket passage 71 and functions to return oil from the oil jacket 70 to the oil pan 17 which is the oil supply side. In addition, the oil discharge passage 89 is formed in the upper surface of the cylinder block 14 and close to the inside cylinder IC and to the exhaust port 19 so as to extend toward the cam chain chamber 37 like a groove. In this way, the exhaust ports 19, 19 of the inside cylinders IC, IC can efficiently be cooled.

In the embodiment, as shown in FIG. 3, the discharge ports 89*a* of the oil discharge passages 89 are each provided to face the downward lateral surface of the cam chain 37*a*. Thus, the oil discharged from the discharge port 89*a* is transferred to the downside of the internal combustion engine 10 by the cam chain 37*a* and returned into the oil pan 17.

In the embodiment, as shown in FIG. 3, the oil discharge passage 89 is formed like a groove in the mating surface 14*b* between the cylinder block 14 and the cylinder head 15 to extend from the downstream end of the first jacket passage 71 toward the cam chain chamber 37. The oil discharge passage 89 communicates with the downstream end of the first jacket passages 71 at its upstream end. Thus, oil is transferred from the downstream end of the first jacket passage 71 to the upstream end of the oil discharge passage 89.

As shown in FIG. 1, a lubricating system oil passage 90 adapted to supply oil to lubrication portions (various rotating shafts, gears, etc.) of the internal combustion engine 10 is connected to the discharge port 52*a* of the lubricating oil pump 52. The lubricating system oil passage 90 includes a lubricating oil supply pipe 91 connected to the discharge port 52*a* of the lubricating oil pump 52; and a lubricating oil passage 92 adapted to supply oil to the lubrication portions of the internal combustion engine 10. In this way, the cooling system oil passage 80 and the lubricating system oil passage 90 are provided independently of each other so as to extend from the oil pan 17 as a source.

In the embodiment, as shown in FIG. 1, the thermostat valve 63 of the thermostat 60 is disposed in the thermostat chamber 62, which is an oil passage between the cooling oil pump 51 and the oil jacket 70.

In the embodiment, as shown in FIG. 1, the oil return side connecting portion 88, which is a return oil passage of the oil cooler, is connected to the bypass passage 84, which is an oil passage between the thermostat chamber 62 of the thermostat 60 and the oil jacket 70.

Figure 2:
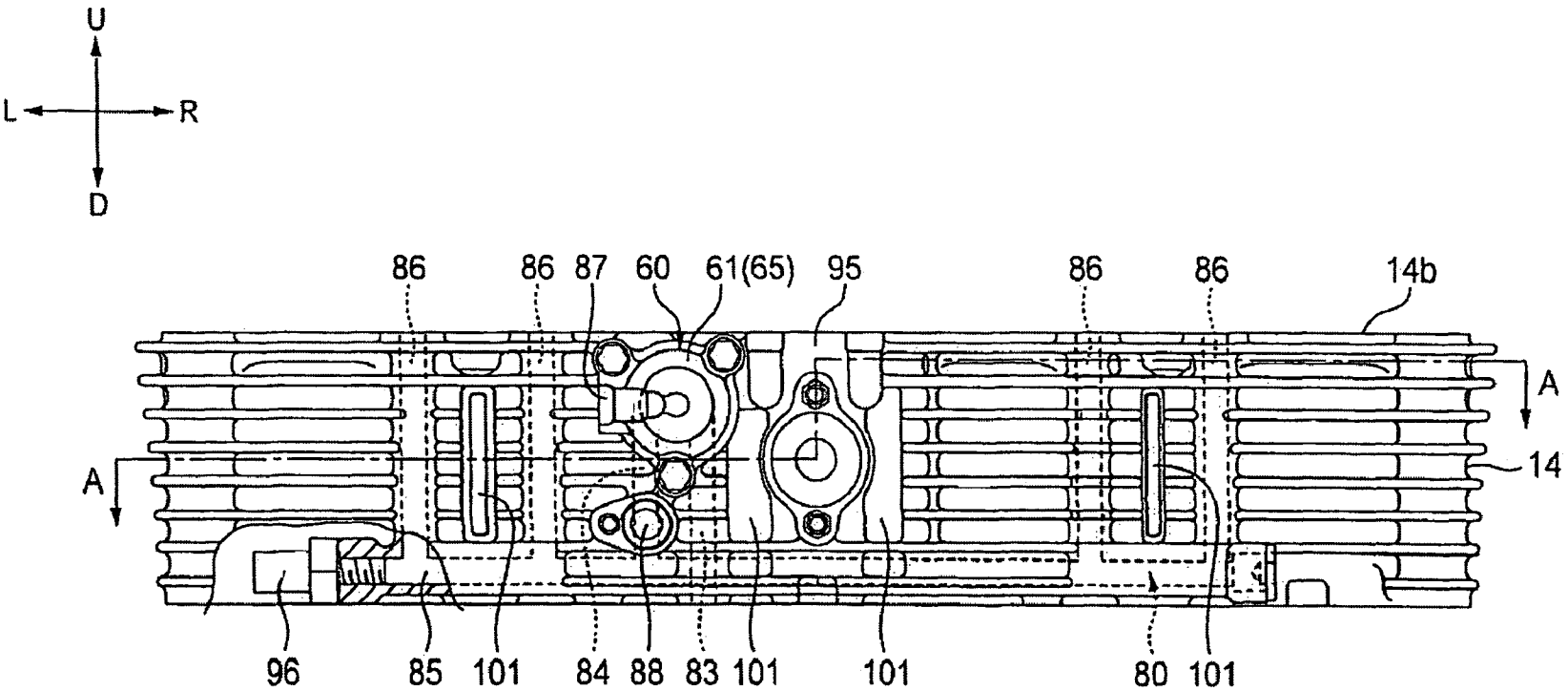
FIG. 2 is a rear view of a cylinder block shown in FIG. 1.

In the embodiment, as shown in FIGS. 2 through 4, a bulging portion 95 resulting from the cam chain chamber 37 is formed at the cylinder-arrangement directional central portion of the rear surface of the cylinder block 14 and cylinder head 15. The thermostat 60 is provided adjacently to the left of the bulging portion 95.

In the embodiment, as shown in FIG. 5, the following are formed to be exposed to the mating surface 15*b* of the cylinder head 15 with the cylinder block 14: the upstream end of the first jacket passage 71, which is an end of the first jacket passage 71 close to the intake port 18; the downstream end of the first jacket passage 71, which is an end of the first jacket passage 71 close to the exhaust port 19; the upstream end of the second jacket passage 72, which is an end of the second jacket passage 72 close to the intake port 18; and a through-hole 76 adapted to receive a leg portion, passed therethrough, of the core used to form the oil jacket 70, the through-hole 76 being an end of the second jacket passage 72 close to the exhaust port 19. The through-hole 76 is closed with a plug member 77.

In the embodiment, as shown in FIG. 2, an oil temperature sensor 96 is disposed at the rearward of the cylinder block 14 in the vehicle traveling direction. This oil temperature sensor 96 is attached from the axial direction of the oil distribution passage 85 to a screw portion (not shown) formed on the internal circumference of the left end of the oil distribution passage 85. In addition, the oil temperature sensor 96 is disposed inwardly of the cylinder-arrangement directional end of the cylinder block 14.

In the embodiment, as shown in FIG. 4, the oil branch passages 86 are formed in the rear surface portion of the cylinder block 14 so as to be separate from the corresponding cylinder bores 14*a*. Therefore, the oil passing through the oil branch passages 86 can be prevented from being heated by the cylinder bores 14*a* and the like. This makes it possible to improve the cooling efficiency of the oil jacket 70.

In the cooling system 40 of the internal combustion engine 10 configured described above, during warm-up operation, the oil supplied under pressure from the cooling oil pump 51, because of the bypass passage 84 opened by the thermostat valve 63, circulates in the following order: the cooling oil supply pipe 81→the first oil supply passage 82→the second oil supply passage 83→the thermostat chamber 62→the bypass passage 84→the oil distribution passage 85→the oil branch passage 86→the oil jacket 70→the oil discharge passage 89→the cam chain chamber 37→the crank chamber 21→the oil pan 17→the cooling oil pump 51.

After the warm-up operation is completed, the oil supplied under pressure from the cooling oil pump 51, because of the oil discharge side connecting portion 87 opened by the thermostat valve 63, circulates in the following order: the cooling oil supply pipe 81→the first oil supply passage 82→the second oil supply passage 83→the thermostat chamber 62→the oil discharge side connecting portion 87→the oil cooler→the oil return side connecting portion 88→the bypass passage 84→the oil distribution passage 85→the oil branch passage 86→the oil jacket 70→the oil discharge passage 89→the cam chain chamber 37→the crank chamber 21→the oil pan 17→the cooling oil pump 51.

In the embodiment, as shown in FIGS. 2 and 4, a cooling air passage 101 is formed between the cam chain chamber 37 and each of the inside cylinders IC in the cylinder block 14 and between the respective cylinder bores 14*a* of the inside cylinder IC and outside cylinder OC so as to lead cooling air (running air) from the front to rear of the vehicle. Thus, the cooling air introduced into the cooling air passages 101 cools the respective cylinder bores 14*a* of the cylinders and is discharged outward.

Figure 6:
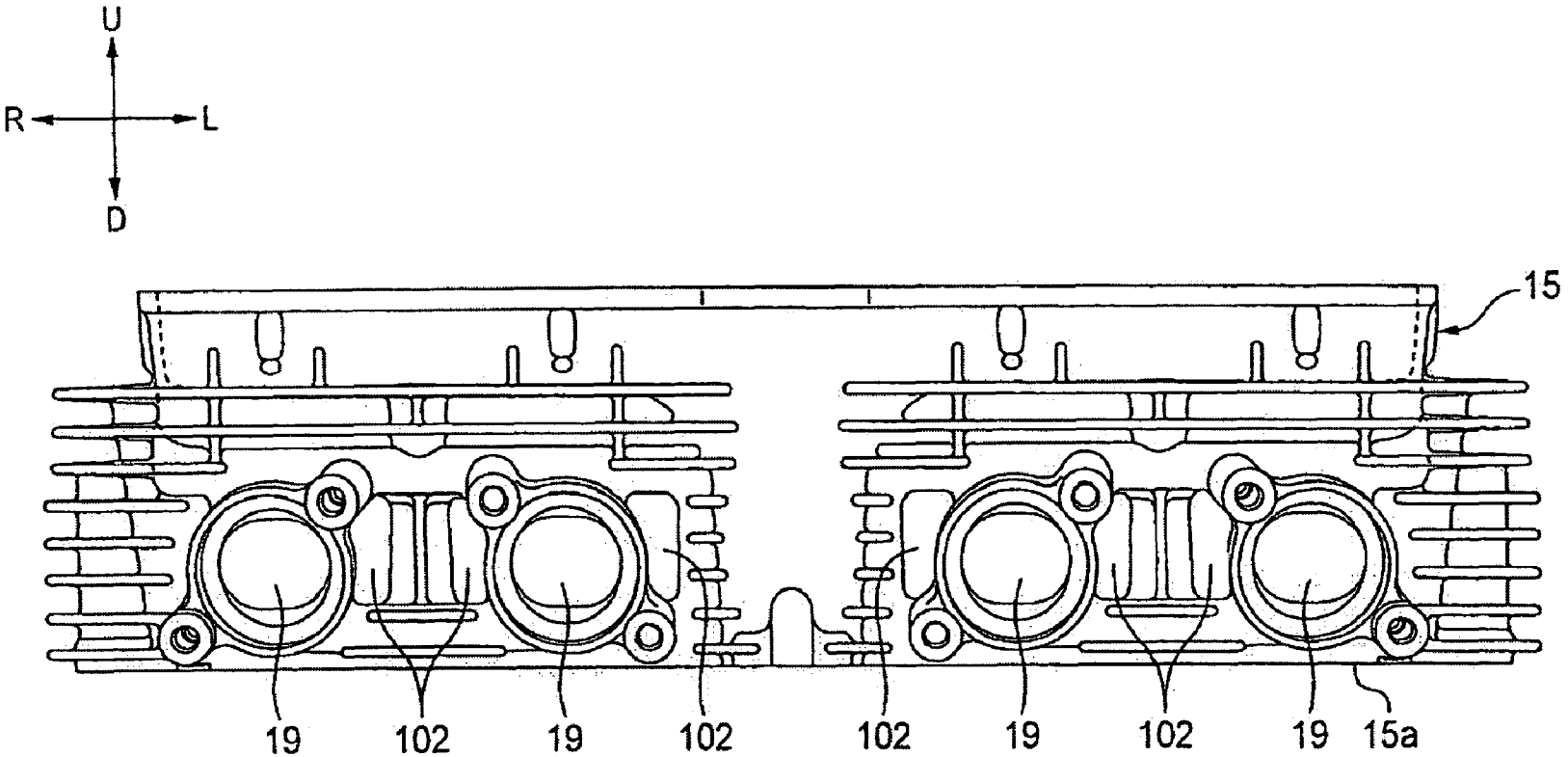
FIG. 6 is a front view of a cylinder head shown in FIG. 5.
Figure 7:
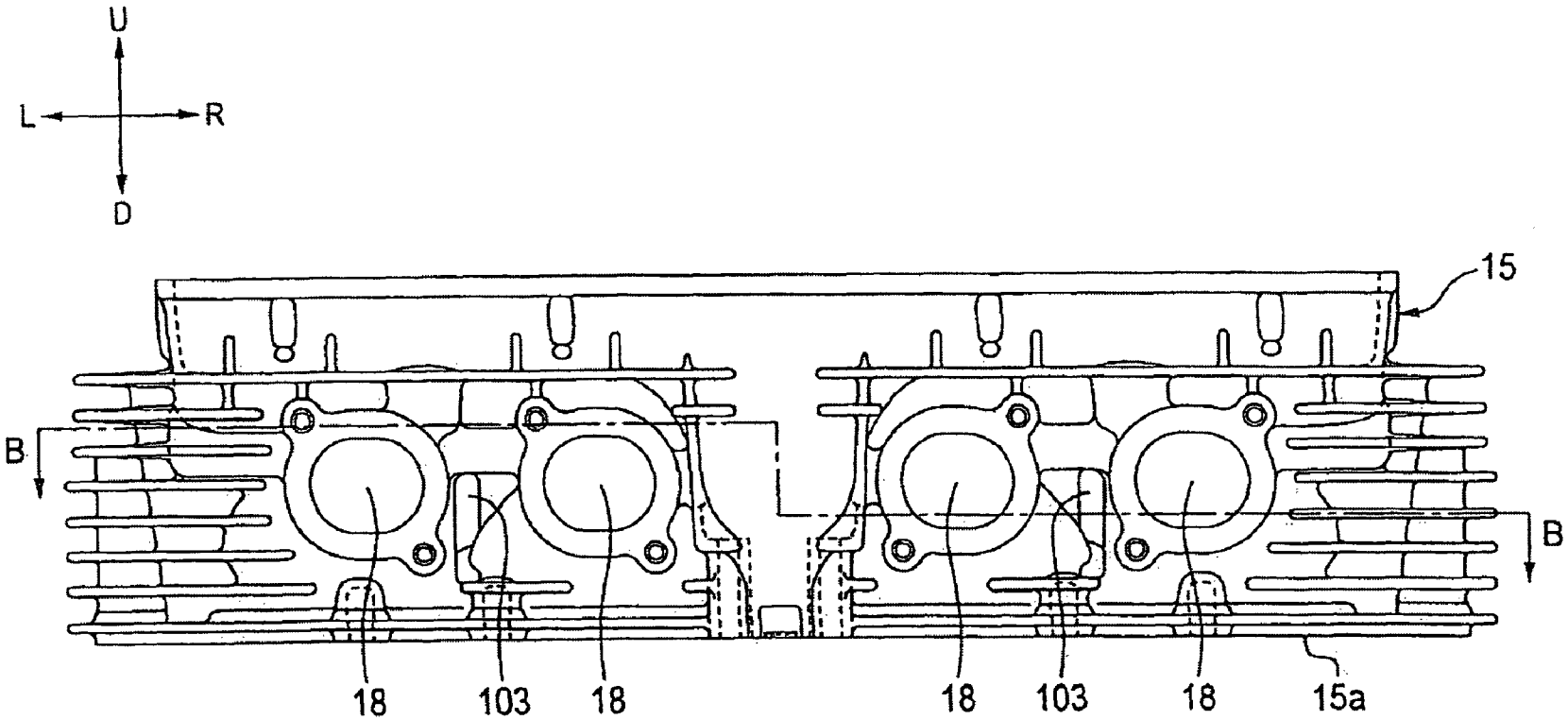
FIG. 7 is a rear view of a cylinder head shown in FIG. 5.

In the embodiment, as shown in FIGS. 6 through 8, a cooling air introduction port 102 is formed close to the exhaust ports 19, and between the cam chain chamber 37 and inside cylinder IC of the cylinder head 15 and between the inside cylinder IC and the outside cylinder OC so as to introduce cooling air to the recessed portion 39 of the cylinder head 15 from the front of the vehicle. In addition, a cooling air leading-out port 103 is formed closed to the intake ports 18 and between the inside cylinder IC and outside cylinder OC of the cylinder head 15 so as to lead cooling air out of the recessed portion 39 toward the rearward of the cylinder head 15. Thus, the cooling air introduced from the cooling air introduction ports 102 cools the portions inside the recessed portions 39 and the peripheries of the plug seats 15*a* and then led out of the cooling air leading-out portions 103 and of an opening portion at the cylinder-arrangement directional outer end of each recessed portion 39.

Figure 9:
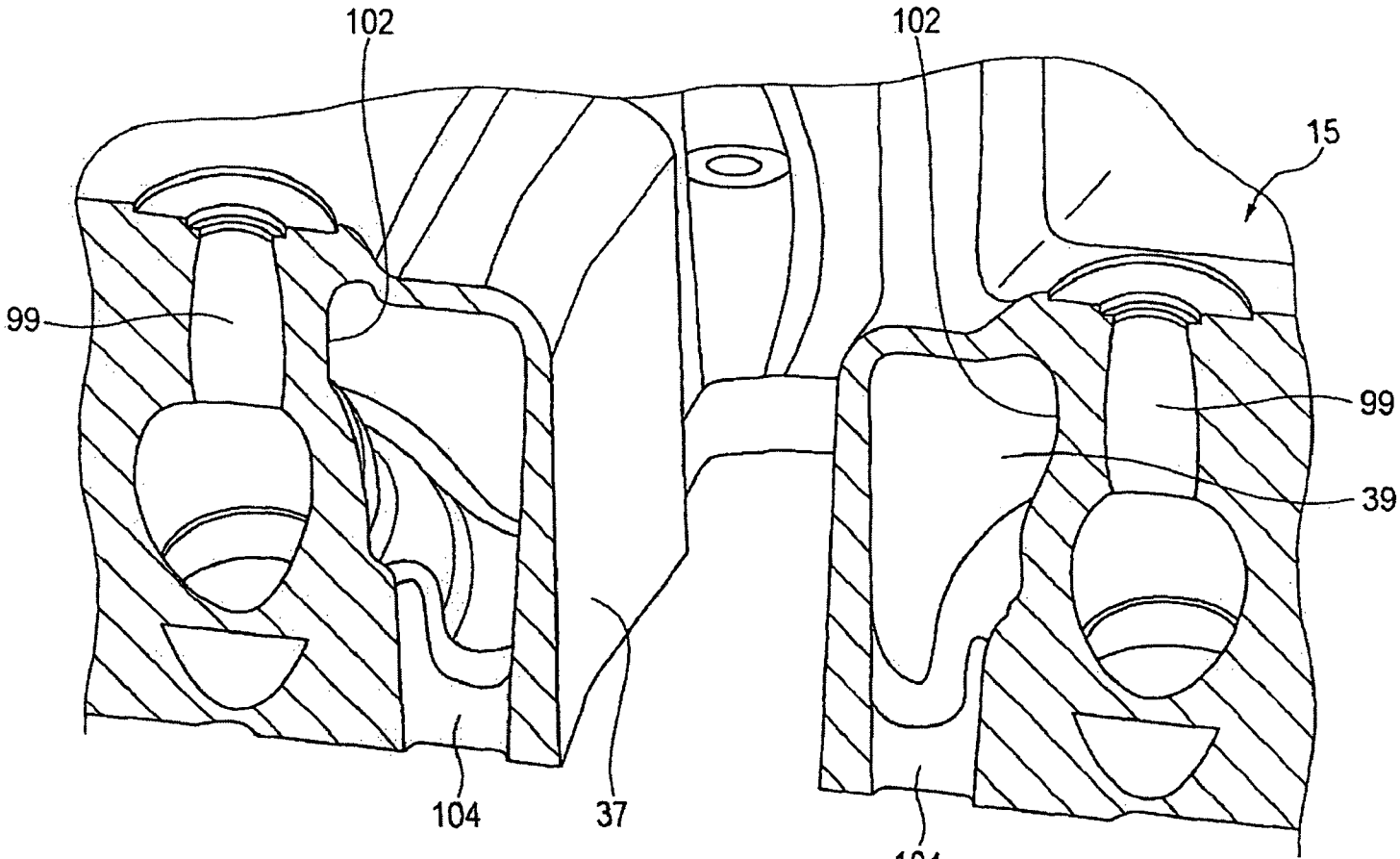
FIG. 9 is a cross-sectional view taken along line C-C of FIG. 8.

In the embodiment, as shown in FIGS. 9 and 10, first cooling air introduction passages 104 are each formed to longitudinally pass through the cylinder block 14 and cylinder head 15 at a portion between the cam chain chamber 37 and the inside cylinder IC, close to the exhaust port 19, and adjacent to the cam chain chamber 37 so as to communicate from the inside cooling air passage 101 to the recessed portion 39. In addition, second cooling air introduction passages 105, 105 are formed to longitudinally pass through the cylinder block 14 and cylinder head 15 at respective portions forward of and rearward of a line connecting the respective cylinder centers of the inside cylinder IC and the outside cylinder OC so as to communicate from the front and rear ends of the outside cooling air passage 101 to the recessed portion 39.

In this way, a portion of cooling air led into the inside cooling air passage 101 is led into the first cooling air introduction passage 104 to cool between the cam chain chamber 37 and the inside cylinder IC and then led to the recessed portion 39. A portion of cooling air led into the outside cooling air passage 101 and a portion of cooling air having passed through the outside cooling air passage 101 are led into the second cooling air introduction passages 105, 105 to cool between the inside cylinder IC and the outside cylinder OC and then led into the recessed portion 39. The cooling air led into the recessed portion 39 merges with the cooling air led from the cooling air introduction port 102. The merging cooling air cools the portions inside the recessed portion 39 and the peripheries of the plug seat 15*a* and then is led to the outside from the cooling air leading-out port 103 and from an opening portion at the cylinder-arrangement directional outer end of the recessed portion 39.

In the embodiment, as shown in FIGS. 3 through 5, 8 and 10, the first and second cooling air introduction passages 104, 105 are each disposed adjacent to a corresponding one of stud bolt insertion holes 97 adapted to receive stud bolts inserted thereto. The stud bolts are used to fasten the cylinder block 14 and cylinder head 15 to the crankcase 11. Incidentally, reference numeral 98 in the figures denotes a cooling fin provided on the bottom of the recessed portion 39 to extend upright therefrom. Reference numeral 99 denotes a valve insertion hole adapted to receive each of the intake and exhaust valves inserted thereinto, the intake and exhaust valves opening and closing the intake and exhaust ports 18, 19, respectively.

In the embodiment, as shown in FIGS. 8 and 10, the camshaft housing chambers 38 are each formed to overhang toward the recessed portion 39. In this way, the first and second cooling air introduction passages 104, 105 are each formed at a position hidden by the overhanging portion of the camshaft housing chamber 38 as viewed from the upper surface of the cylinder head 15.

As described above, according to the cooling structure of the internal combustion engine 10 of the embodiment, the first and second cooling air introduction passages 104, 105 communicate from the cooling air passage 101 to the recessed portion 39 of the cylinder head 15. Therefore, cooling air can efficiently be introduced into the recessed portion 39 to thereby improve the cooling performance of the recessed portion 39. This can make it possible to positively cool, particularly, the plug seat 15*a* disposed in the recessed portion 39 and subjected to high temperature, whereby the cooling performance of the internal combustion engine 10 can be improved. Even while the vehicle is being parked and no cooling air flows into the cooling air passage 101, the first and second cooling air introduction passages 104, 105 allow the cylinder block 14 to communicate with the recessed portion 39 of the cylinder head 15; therefore, convection flow occurs due to the increased temperature of neighboring air. This movement of air introduces fresh air into the recessed portion 39 while heated air is not staying therein. Thus, cooling performance of the internal combustion engine 10 can be improved during idling.

According to the cooling structure of the internal combustion engine 10 of the present embodiment, the cam chain chamber 37 for housing the cam chain 37*a* is formed at the cylinder-arrangement directional central portion, the first cooling air introduction passage 104 is disposed adjacently to the cam chain chamber 37, and the cylinder-arrangement end of the recessed portion 39 is formed to open toward the outside. Therefore, cooling air can be led to the side of the cam chain chamber 37 where air tends to stay in the recessed portion 39. Thus, the cooling performance of the internal combustion engine 10 can further be improved. Since the cylinder-arrangement directional outer end of the recessed portion 39 is formed to open outwardly, the negative pressure of running air acts on the opening portion of the recessed portion 39. This further promotes the introduction of cooling air from the first and second cooling air introduction passages 104, 105 to further improve the cooling performance of the recessed portion 39.

According to the cooling structure of the internal combustion engine 10 of the present embodiment, the second cooling air introduction passages 105, 105 are formed between the cylinder bores 14*a* and forward of and rearward of the line connecting cylinder centers. Therefore, the areas between the respective cylinder bores 14*a* of the inside cylinder IC and of the outside cylinder OC can be cooled to improve the cooling performance of the internal combustion engine 10.

Further, according to the cooling structure of the internal combustion engine 10 of the present embodiment, the cam shaft housing chamber 38 is formed to hang over toward the recessed portion 39 and the first and second cooling air introduction passages 104, 105 are formed at a position hidden by the overhanging portion of the cam shaft housing chamber 38, as viewed from the top surface of the cylinder head 15. Therefore, the space of the recessed portion 39 can be increased by the camshaft housing chamber 38 formed to overhang toward the recessed portion 39, thereby increasing the surface area to enhance cooling performance. It is possible to introduce fresh air into the overhanging portion where air tends to stay in the recessed portion, which can further improve the cooling performance of the internal combustion engine.

Although a specific form of embodiment of the instant invention has been described above and illustrated in the accompanying drawings in order to be more clearly understood, the above-description is made by way of example and not as a limitation of the scope of the instant invention. It is contemplated that various modifications apparent to one of ordinary skill in the art could be made without departing from the scope of the invention which is to be determined by the following claims.

I claim:

1. A cooling structure of an internal combustion engine, comprising:

a cylinder block having a plurality of cylinder bores;

a cylinder head disposed on an upper portion of said cylinder block, said cylinder head having a recessed portion;

two camshafts disposed on said cylinder head in parallel to a crankshaft;

camshaft housing chambers formed on said cylinder head to respectively house said camshafts;

a plug seat formed between said camshafts and in said recessed portion;

a cooling air passage formed between said cylinder bores; and a cooling air introduction passage communicating said cooling air passage with said recessed portion of said cylinder head, wherein said recessed portion of said cylinder head is provided between said camshaft housing chambers.

2. The cooling structure of an internal combustion engine according to claim 1, further comprising a cam chain chamber for housing a cam chain, formed at a cylinder-arrangement central portion, wherein said cooling air introduction passage is disposed adjacent to said cam chain chamber, and wherein a cylinder-arrangement end of said recessed portion is open toward the outside of said cylinder head.

3. The cooling structure of an internal combustion engine according to claim 1, wherein said cooling air introduction passage is formed between said cylinder bores and forward of and rearward of a line connecting cylinder centers.

4. The cooling structure of an internal combustion engine according to claim 2, wherein said cooling air introduction passage is formed between said cylinder bores and forward of and rearward of a line connecting cylinder centers.

5. The cooling structure of an internal combustion engine according to claim 1, wherein said cam shaft housing chamber is formed to overhang toward said recessed portion, and wherein at least a portion of said cooling air introduction passage is formed at a position hidden by said camshaft housing chambers, as viewed from the upper surface of said cylinder head.

6. The cooling structure of an internal combustion engine according to claim 2, wherein said cam shaft housing chamber is formed to overhang toward said recessed portion, and wherein at least a portion of said cooling air introduction passage is formed at a position hidden by said camshaft housing chambers, as viewed from the upper surface of said cylinder head.

7. The cooling structure of an internal combustion engine according to claim 3, wherein said cam shaft housing chamber is formed to overhang toward said recessed portion, and wherein at least a portion of said cooling air introduction passage is formed at a position hidden by said camshaft housing chambers, as viewed from the upper surface of said cylinder head.

8. The cooling structure of an internal combustion engine according to claim 4, wherein said cam shaft housing chamber is formed to overhang toward said recessed portion, and wherein at least a portion of said cooling air introduction passage is formed at a position hidden by said camshaft housing chambers, as viewed from the upper surface of said cylinder head.

* * * * *